US008801311B1

(12) United States Patent
Miller

(10) Patent No.: US 8,801,311 B1
(45) Date of Patent: Aug. 12, 2014

(54) WRITING IMPLEMENT ORGANIZING DEVICE

(76) Inventor: Angela Miller, Lynn, MA (US)

( * ) Notice: Subject to any disclaimer, the term of this patent is extended or adjusted under 35 U.S.C. 154(b) by 776 days.

(21) Appl. No.: 13/034,739

(22) Filed: Feb. 25, 2011

(51) Int. Cl.
*B43K 23/02* (2006.01)

(52) U.S. Cl.
USPC ..... 401/131; 401/195; 24/298

(58) Field of Classification Search
USPC ..... 401/131, 48, 195, 88; 24/3.13, 298, 24/300, 301, 302
See application file for complete search history.

(56) References Cited

U.S. PATENT DOCUMENTS

| | | | | |
|---|---|---|---|---|
| 761,399 | A | 5/1904 | Pond | |
| 1,814,710 | A * | 7/1931 | Komorous | 24/116 A |
| 2,285,000 | A | 6/1942 | Wallace | |
| 4,699,536 | A | 10/1987 | Berman | |
| 5,360,342 | A | 11/1994 | Pardner | |
| 6,318,921 | B1 | 11/2001 | Craine | |
| 7,563,047 | B2 * | 7/2009 | Paluda | 401/131 |

* cited by examiner

*Primary Examiner* — David Walczak
(74) *Attorney, Agent, or Firm* — Robert C. Montgomery; Montgomery Patent & Design

(57) ABSTRACT

A writing implement organizing device mechanically links multiple writing instruments to a central hub and includes a plurality of cords having an end attached to each writing instrument. Each cord is formed of an elastic material with an end attached a desired writing instrument.

18 Claims, 4 Drawing Sheets

WRITING IMPLEMENT ORGANIZING DEVICE

RELATED APPLICATIONS

The present invention was first described in a notarized Official Record of Invention on Jun. 14, 2010, that is on file at the offices of Montgomery Patent and Design, LLC, the entire disclosures of which are incorporated herein by reference.

FIELD OF THE INVENTION

The present invention relates generally to writing instruments, and in particular, to a writing instrument organizing device for linking a plurality of writing instruments to a central hub.

BACKGROUND OF THE INVENTION

Coloring with crayons remains a favorite activity of all children. Even in this age of specialized electronics, touch sensitive screens, and interactive programs, the ability to take a writing utensil and display one's thoughts, feelings, and images upon a piece of paper will remain fun for generations to come. However, misplaced crayons, missing markers, pencils that roll off of the table and other annoyances remain as the major disadvantage of such activities. These disadvantages also extend to parents or care providers who must constantly clean up after such activities and ensure that all writing utensils have been found and properly stored away.

SUMMARY OF THE INVENTION

The inventor has therefore recognized the aforementioned inherent problems and lack in the art and observed that there is a need for a device and a method of use by which the fun and enjoyment of using multiple writing instruments can be enjoyed by all children without the disadvantages as described above. In accordance with the invention, it is an object of the present disclosure to solve these problems.

The inventor recognized these problems and has addressed this need by developing a writing implement organizer that provides the ability to join writing instruments together in a manner which keeps them always easy to find, use, and write with. The inventor has thus realized the advantages and benefits of providing a spherical bead having a bead aperture disposed entirely through a central axis and a plurality of cords threaded entirely through the bead aperture. Opposing end portions of each cord are exposed and extend outwardly from the bead. A plurality of elongated rigid tubes is also provided. Each of the tubes receives a single cord threaded entirely therethrough, such that the tube is disposed between the bead and the writing instrument. The bead is positioned at a central location on the plurality of cords. The opposing end portions of each cord are fastened to an end of a writing instrument opposite a writing tip. The plurality of cords mechanically links the plurality of writing instruments to the bead.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
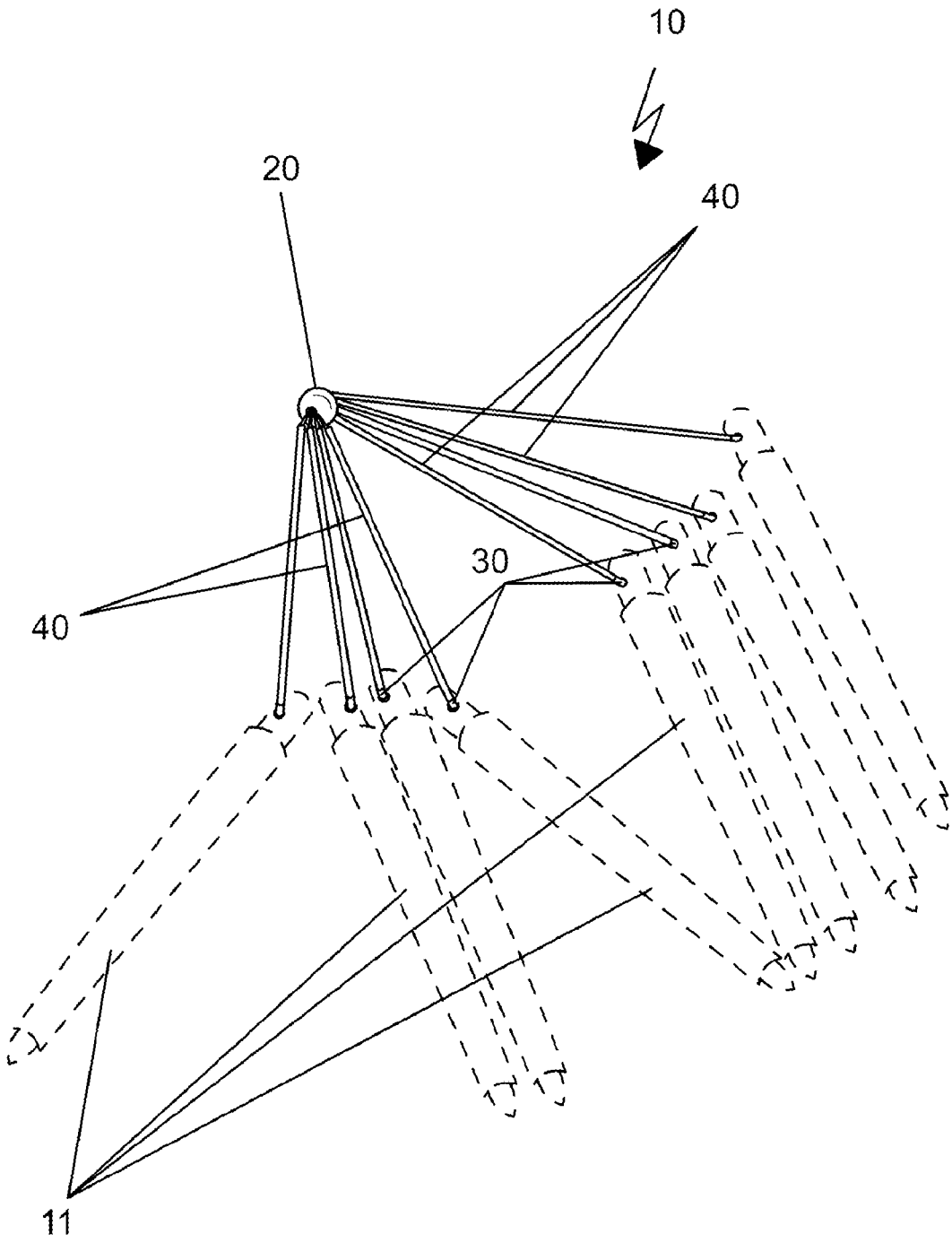
FIG. 1 is an environmental view of a writing implement organizing device, according to a preferred embodiment in accordance with the invention.

10 writing implement organizing device
11 writing instrument
20 bead
25 bead aperture
30 cord
35 knot
40 tube
50 alternate embodiment

DETAILED DESCRIPTION OF THE PREFERRED EMBODIMENT

Figure 2:
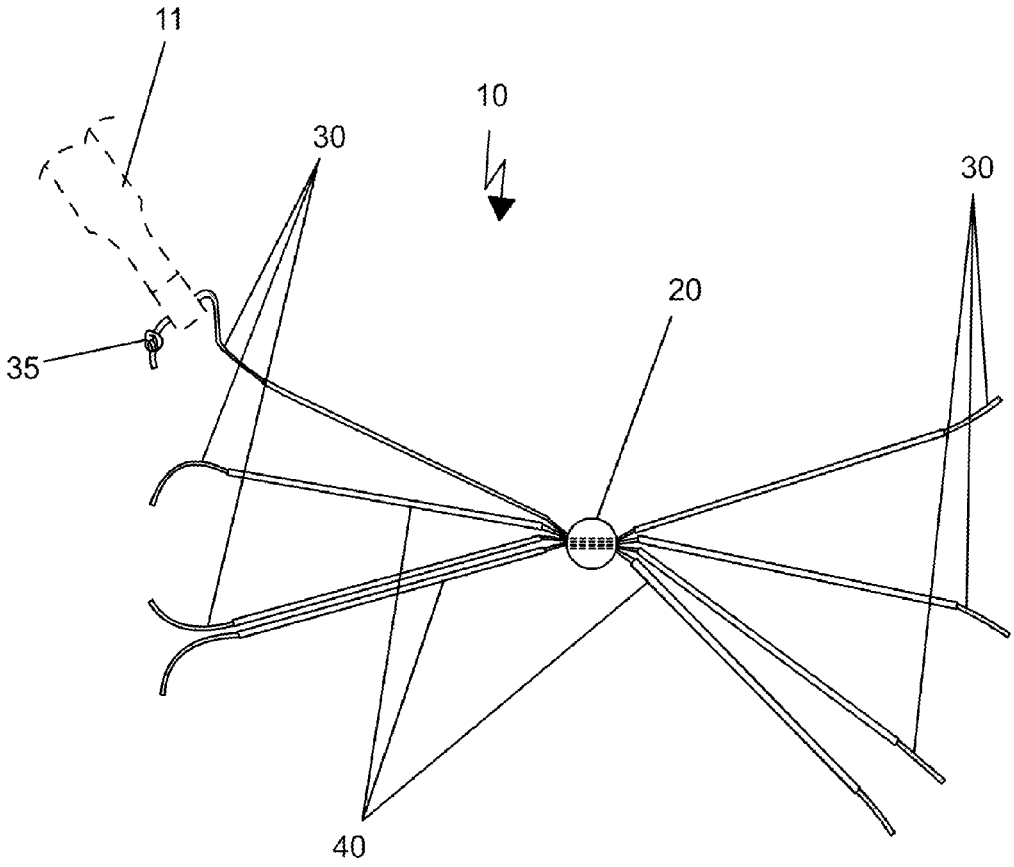
FIG. 2 is a perspective view of the writing implement organizing device, according to the preferred embodiment.
Figure 3:
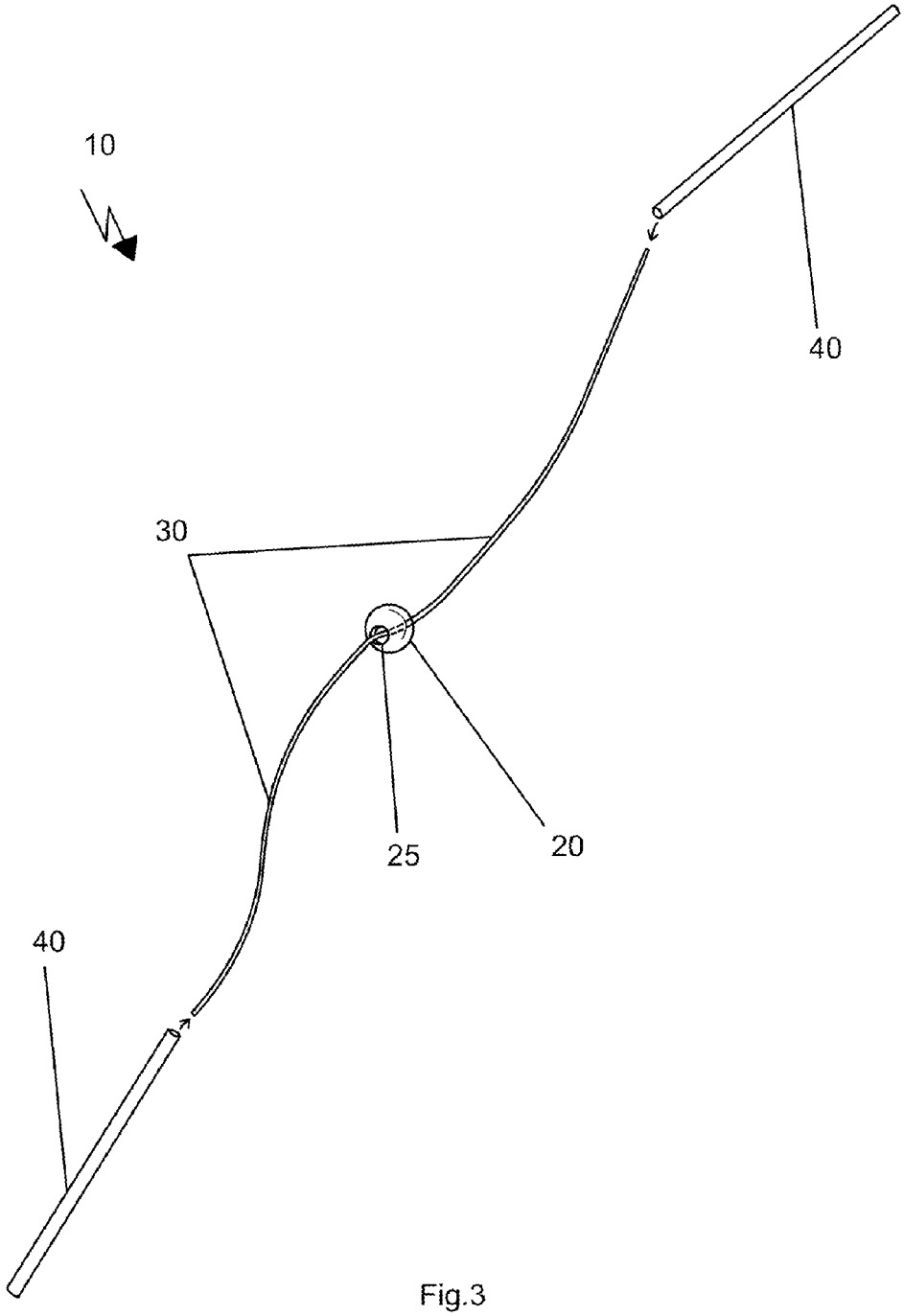
FIG. 3 is an exploded view of an individual cord routed through a bead, according to the preferred embodiment; and, FIG. 4 is an environmental view of an alternate embodiment of the writing implement organizing device, according to an alternate embodiment in accordance with the invention.
Figure 4:
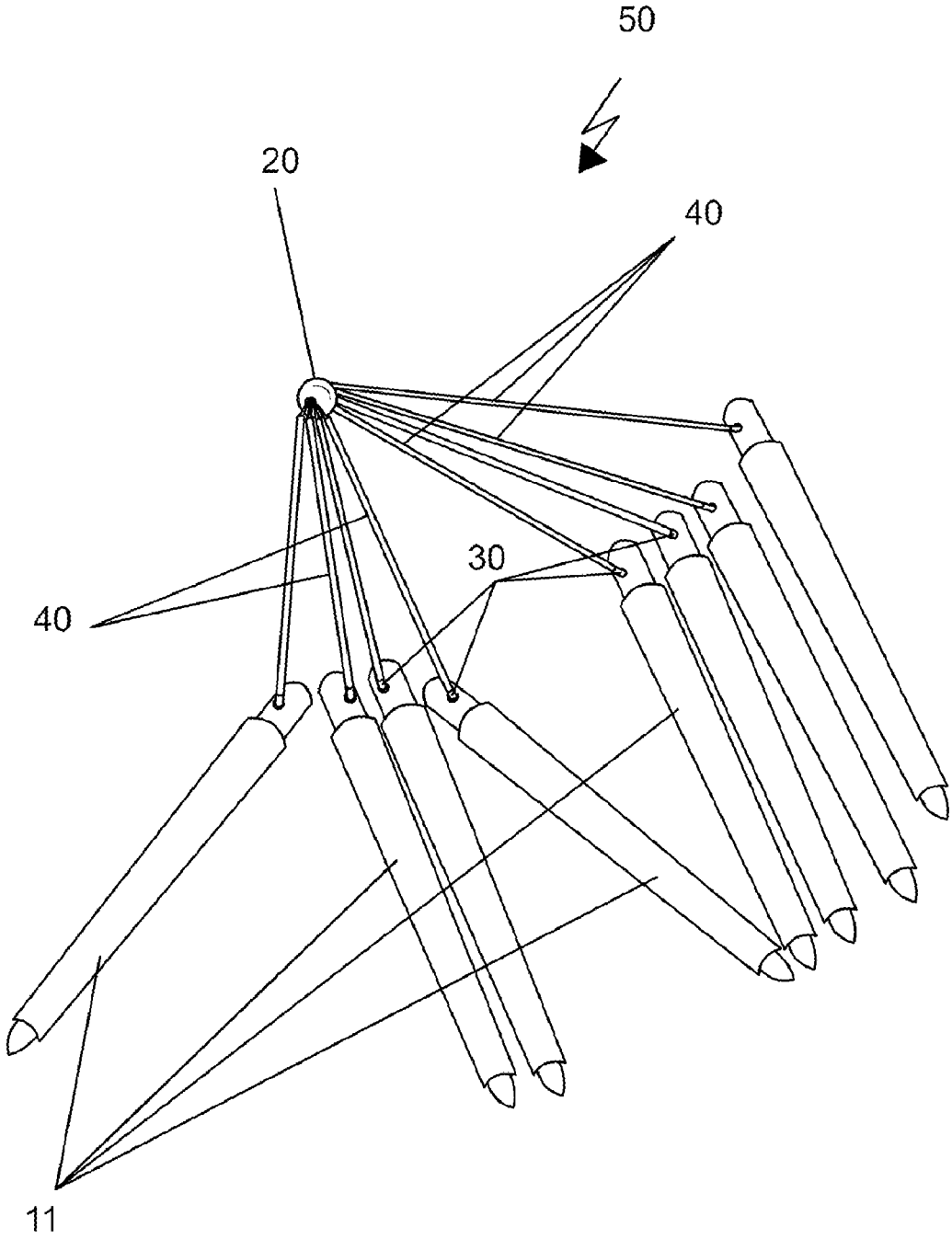

In accordance with the invention, the best mode is presented in terms of the preferred embodiment depicted within FIGS. 1 through 3 and in terms of an alternate embodiment depicted within FIG. 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 3, depicting a writing implement organizing device (herein described as a "device") 10 and to FIG. 4, depicting an alternate embodiment of the writing implement organizing device (herein described as an "alternate embodiment") 50, where like reference numerals represent similar or like parts. The device 10 and alternate embodiment 50 generally provide for the tethering of a plurality of writing instruments 11 such as, but not limited to: crayons, colored pencils, colored pens, and similar marking devices together which prevents and eliminates misplacing the writing utensils 11. The device 10 and alternate embodiment 50 are preferably purchased separately as desired by the manufacturer to fit the particular writing instruments 11.

Referring to FIG. 1, an environmental view of the device 10. The device 10 tethers a plurality of writing instruments 11 together about a single bead 20. Although the device 10 is depicted as securing eight (8) writing instruments 11, it can be appreciated by one of ordinary skill in the art that more or less the writing instruments 11 can be utilized without limiting the scope of the device 10. The device 10 also includes a plurality of cords 30 and a plurality of tubes 40 which interconnect and secures the writing instruments 11 and provides a way of limiting the distance between the writing instruments 11 and the bead 20.

Referring to FIG. 2, a perspective view of the device 10 and FIG. 3, an exploded view of the device 10. FIG. 2 depicts a single writing instrument 11 attached to one (1) of the plurality of cords 30 for illustration purposes only and it is understood that each end of each cord 30 is attached to a separate writing instrument 11 in a preferred use. FIG. 3 depicts a single cord 30 extending completely through the bead 20 for illustration purposes only and it is understood that the plurality of cords 30 is utilized without limiting the scope of the device 10. The bead 20 acts as a central hub of the device 10 and provides a single point to connect and secure the writing instruments 11 as a single unit.

The bead 20 in at least one (1) embodiment is generally solid and includes a bead aperture 25 which receives the cords 30 when threaded therethrough. The bead 20 is fabricated from materials such as, but not limited to: plastic, metal, or the like. A plurality of cords 30 are completely threaded through the bead aperture 25, preferably having equal lengths of cord 30 on each side of the bead 20. The cords 30 are preferably made of an elastic material. The cord 30 and the bead aperture 25 are appropriate sized to allow for the plurality of cords 30 to be bundled and completely threaded through the bead aperture 25.

A tube 40 receives opposing end of each cord 30 and provides for distance regulation between the writing instrument 11 and the bead 20. Each tube 40 is preferably equal in length and diameter. The diameter of the tube 40 is preferably greater than the diameter of the bead aperture 25, such that the tube 40 cannot pass through the bead aperture 25. Each tube 40 is preferably fabricated from materials such as, but not limited to: plastic, metal, or the like.

Once each end of the cord 30 is completely threaded through a respective tube 40, and end portion of the cord 30 protrudes beyond an end of the tube 40 opposite the bead 20. After each of the plurality of cords 30 is passed through the bead aperture 25 and opposing ends of each cord 30 are passed through a corresponding tube 40, a writing instrument 11 is attached to each end portion of the cord 30. The end portion of the cord 30, which is not encompassed by the tube 40, is passed through the writing instrument 11 and a knot 35 is tied to secure the writing instrument 11 to the cords 30. However, it can be appreciated by one of ordinary skill in the art that other methods of attachment to the writing instruments 11 can be utilized including, but not limited to: welding, clamping, or similar mechanical fastening methods.

The device 10 is intended for use with writing instruments having a through hole disposed in a cap or end portion to receive the end portion of each cord 30. This through hole will be provided in the body of the writing instrument by the particular manufacturer. An example of a preferred writing instrument is a CRAYOLA® brand twistable crayon and marker. The device 10 can also be used with any other type of writing instrument 11 by drilling or tapping a through hole in the body of the writing instrument 11 to receive the cord 30.

FIG. 4 shows an environmental view of the alternate embodiment 50. The alternate embodiment 50 includes the writing instruments 11 as integral to the cords 30 and provided as such as a single article. The cords 30 are integrated to an end portion of the writing instruments 11 by integral molding, mechanical fastening, adhesives, or similar permanent fastening methods. The bead 20 and plurality of tubes 40 interact with the plurality of cords 30 in a substantially similar manner as described for the preferred embodiment of the device 10.

It is envisioned that other styles and configurations can be easily incorporated into the teachings of the disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be installed as indicated in FIG. 1.

The method of installing and utilizing the device 10 may be achieved by performing the following steps. The user first acquires the device 10 in a state of complete disassemble and a plurality of writing instruments 11 which are to be coupled to the end portions of the cords 30. Each of the plurality of cords 30 is threaded completely through the bead aperture 25. A tube 40 is then slid over each half of the cord 30 from an end portion to the bead 20. The end portions of each cord 30 is then coupled to the particular writing instrument 11 and secured by tying the end portion in a knot 35. The writing instruments 11 are then used in a common manner as the device 10 provides the ability to join the writing instruments 11 together in a manner which keeps them always easy to find, use, and write with.

The method of utilizing the alternate embodiment 50 may be achieved by performing the following steps. The user first acquires the alternate embodiment 50 in a state of complete assembly. The writing instruments 11 are then utilized in a common manner as the alternate embodiment provides the ability to join the writing instruments 11 together in a manner which keeps them always easy to find, use, and write with.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A writing implement organizing device comprising:

a central hub, comprising a generally solid bead having a bead aperture disposed entirely through a central axis; and, a plurality of cords extending outwardly from said central hub; and a plurality of elongated tubes, each of said tubes insertingly receives a single cord threaded entirely therethrough;

wherein an end portion of each of said cords opposite said central hub is fastened to an end of a writing instrument opposite a writing tip;

wherein each tube is disposed between said bead and said writing instrument;

wherein said end portions of said plurality of cords extend outwardly from said bead aperture; and, wherein said plurality of cords mechanically link a plurality of writing instruments to said central hub.

2. The device of claim 1, wherein said bead further comprises a spherical body.

3. The device of claim 2, wherein each of said plurality of cords further comprises a flexible material.

4. The device of claim 3, wherein each of said plurality of cords is threaded entirely through said bead aperture, such that both of said end portions of each cord are exposed.

5. The device of claim 4, wherein said bead is positioned at a central location on said plurality of cords.

6. The device of claim 5, wherein each of said plurality of tubes is rigid.

7. The device of claim 6, wherein each of said cords is elastic.

8. The device of claim 7, wherein an outer diameter of each of said tubes is larger than a diameter of said bead aperture.

9. The device of claim 8, wherein said end portion of each of said cords is fastened to said writing instrument end by a knot.

10. The device of claim 8, wherein said end portion of each of said cords is fastened to said writing instrument end by a mechanical fastener.

11. The device of claim 8, wherein said end portion of each of said cords is integrally affixed to said writing instrument end.

12. A writing implement organizing device comprising:

a spherical bead having a bead aperture disposed entirely through a central axis;

a plurality of cords threaded entirely through said bead aperture, such that opposing end portions of each cord are exposed and extend outwardly from said bead; and, a plurality of elongated rigid tubes, each of said tubes insertingly receives a single cord threaded entirely therethrough;

wherein said bead is positioned at a central location on said plurality of cords;

wherein said end portion of each of said cords is fastened to an end of a writing instrument opposite a writing tip;

wherein each tube is disposed between said bead and said writing instrument; and, wherein said plurality of cords mechanically link a plurality of writing instruments to said bead.

13. The device of claim 12, wherein each of said plurality of cords further comprises a flexible, elastic material.

14. The device of claim 13, wherein an outer diameter of each of said tubes is larger than a diameter of said bead aperture.

15. The device of claim 14, wherein said end portion of each of said cords is fastened to said writing instrument end by a knot.

16. The device of claim 14, wherein said end portion of each of said cords is fastened to said writing instrument end by a mechanical fastener.

17. The device of claim 14, wherein said end portion of each of said cords is integrally affixed to said writing instrument end.

18. A method of linking a plurality of writing instruments to a central hub, said method comprising the steps of:

providing a plurality of writing instruments having a writing tip and an end opposite said writing tip;

providing writing implement organizing device comprising a bead having a bead aperture disposed entirely through a central axis, a plurality of cords, each cord having opposing end portions exposed and extending outwardly from said bead, and a plurality of elongated tubes, each of said tubes is disposed between said bead and said writing instrument;

threading each of said plurality of cords through said bead aperture, such that said plurality of cords form a cord bundle and said bead is located at a central position of said cord bundle;

threading each of said end portion of each cord entirely through a single tube, such that said tube is disposed between said cord end portion and said bead; and, fastening each of said cord end portions to said writing instrument end opposite said writing tip.

* * * * *